US006948949B1

(12) United States Patent
Schwartz et al.

(10) Patent No.: US 6,948,949 B1
(45) Date of Patent: Sep. 27, 2005

(54) ELECTRICAL CONNECTOR WITH AN IMPROVED TERMINAL BLOCK

(75) Inventors: Greg Schwartz, South Salem, NY (US); Chris Poulin, Mohegan Lake, NY (US); Peter R. Daly, Yorktown Heights, NY (US); Dominick H. Salvato, North Salem, NY (US)

(73) Assignee: BTX Technologies, Inc., Hawthorne, NY (US)

( * ) Notice: Subject to any disclaimer, the term of this patent is extended or adjusted under 35 U.S.C. 154(b) by 87 days.

(21) Appl. No.: 10/850,578

(22) Filed: May 19, 2004

(51) Int. Cl.[7] ..... H01R 13/66
(52) U.S. Cl. ..... 439/76.1; 439/638
(58) Field of Search ..... 439/76.1, 813, 439/565, 881, 654, 876, 620, 638, 76.2, 75, 439/814

(56) References Cited

U.S. PATENT DOCUMENTS 4,836,804 A * 6/1989 London et al. ..... 439/598
5,026,293 A * 6/1991 Wilson ..... 439/76.1
5,347,084 A * 9/1994 Roney et al. ..... 174/92
5,545,848 A * 8/1996 Lin ..... 174/52.1
5,827,092 A * 10/1998 Minich ..... 439/620
6,176,743 B1 * 1/2001 Kuo ..... 439/638
6,296,534 B1 * 10/2001 Yi ..... 439/876
6,319,066 B2 * 11/2001 Kuo ..... 439/638
6,343,957 B1 * 2/2002 Kuo et al. ..... 439/638
6,364,713 B1 * 4/2002 Kuo ..... 439/638
6,461,195 B2 * 10/2002 Chang ..... 439/622

* cited by examiner

*Primary Examiner*—Ross Gushi
*Assistant Examiner*—Phuongchi Nguyen
(74) *Attorney, Agent, or Firm*—Darby & Darby

(57) ABSTRACT

An electrical connector for electrical connection to an electronic device includes: (1) a terminal block assembly formed of: (a) a connector base having first conductive members associated therewith; (b) a printed circuit board that includes a plurality of conductive paths formed thereon and is coupled to the connector base such that the first conductive members contact the plurality of conductive paths; and (c) one or more terminal blocks each formed of a housing that includes first openings for receiving second conductive members and a plurality of contacts disposed therein along with a plurality of contact fasteners that can be tightened so as to apply a force against the second conductive members so that they are brought into contact with and releasably fixed to respective contacts resulting in the first and second conductive members being electrically connected via the plurality of conductive paths; and (2) a connector housing for receiving and containing the terminal block assembly.

37 Claims, 5 Drawing Sheets

ELECTRICAL CONNECTOR WITH AN IMPROVED TERMINAL BLOCK

TECHNICAL FIELD

The present invention relates generally to an electrical connector and more particularly, to an electrical connector, such as a grid array type connector, that includes an improved means for electrically connecting a plurality of first contacts associated with a first electronic component to a corresponding plurality of second contacts to provide an electrical connection between the first electronic component and a second electronic component that is electrically connected to the second contacts.

BACKGROUND

It is often necessary and desirable to electrically connect one component to another component. For example, a multi-terminal component, such as a connector, is often electrically connected to a substrate, such as a printed circuit board, so that the contacts or terminals of the component are securely attached to contact pads or lined conductive receptacles or the like formed on the substrate to provide an electrical connection therebetween. One preferred technique for securely attaching the component terminals to the contact pads is to use a solder material.

In the electronic equipment and installation industries, an important necessity is the rapid and accurate assembly of leads, terminals and contacts with contact pads or the like associated with printed circuit boards (PCB) and other substrates. For convenience of connecting such elements, it has previously been disclosed to facilitate the soldering of their connection by securing a solder slug or mass to one of the elements so that, when positioned in engagement with the other element and heated, the molten solder will cover the adjacent surfaces of both elements to form when cooled a solder joint providing both a mechanical coupling and an electrical connection between the elements.

One disadvantage of using solder masses is that in some applications the solder masses first have to be formed to have the proper dimensions and then the solder masses have to be coupled to solder-holding elements (e.g., solder clips) before the solder reflow operation is performed. In the case where the solder-holding elements are in the form of a series of claw-like structures formed as part of clips that are spaced along a carrier strip, the claw-like structures are first formed by bending portions of the clip and then one solder mass has to be disposed within one claw-like structure. This can be a time consuming task.

In addition, the electrical connection between one electronic component to another electronic component is many times performed in the field by a skilled technician, especially in certain types of applications. In the field work is many times necessary when installing a computer system in an office or even in a home in some situations since this will permit the technician to carefully and properly trim wires to their proper lengths between establishing an electrical connection between the stripped (shaved) wires and complementary contacts that are associated with an electrical connector that not only makes this connection but also houses the associated electronic components.

For example, one type of connector that is especially common in the computer field and more particularly, that is used in providing an electric connection between one computer component, such as a monitor, and another computer component, such as a hard drive that houses the master controller, etc. With the advent of the Digital Video Disc (DVD) format, manufacturers and users of personal computers are incorporating the ability to playback movies or other recorded material recorded on DVD's via the personal computer. A computer display, unlike an ordinary television, uses a VGA (or similar or equivalent) output signal of the computer. This VGA output signal ("component video") is typically provided on a multiwire bus that provides separately a red video signal, a green video signal, a blue video signal, a set of vertical synchronizing pulses and a set of horizontal synchronizing pulses. The frame rate (refresh rate) is usually 60 frames per second. VGA does not require any one format (resolution) in terms of pixels per line or lines per frame or refresh rate and thus, a variety of pixels per line and lines per frame are accommodated within the VGA standard.

In a typical "in the field" computer installation application, the technician will determine the location of the monitor as well as locating where the main hardware is located relative to the monitor. A VGA cable is then prepared by measuring a distance of stock cable and then cutting it into a small segment that is customized for the particular application. In order to connect the VGA cable to a VGA connector, the ends of the wires within the VGA cable are cut or skinned so that the sheathing around the wires is removed. The wires are then inserted into the VGA connector such that one wire is in placed into contact with one contact, such as a contact plate, or the like and then the two are securely connected to one another typically be performing a soldering operation. Since the VGA cable can have up to 15 wires, this is a tedious, laborious, and time consuming task since the technician has to individually solder up to 15 wires to their respective contact plates or the like. In addition, the connector body is not especially large so that all of this operation has to take place in a very small area. This further complicates matters for the technician. After the technician makes the connections between the wires and the contact plates which are typically a part of a terminal block, the technician then assembles a protective housing around the terminal block. This adds additional time.

Accordingly, it is desirable is a connector that provides an improved means for fixing the conductive wires relative to the contacts without the need for the use of solder material and offers a reduction in the time needed to complete this task.

SUMMARY

An electrical connector for electrical connection to an electronic device includes: (1) a terminal block assembly formed of: (a) a connector base having first conductive members associated therewith; (b) a printed circuit board that includes a plurality of conductive paths formed thereon and is coupled to the connector base such that the first conductive members contact the plurality of conductive paths; and (c) one or more terminal blocks each formed of a housing that includes first openings for receiving second conductive members and a plurality of contacts disposed therein along with a plurality of contact fasteners that can be tightened so as to apply a force against the second conductive members so that they are brought into contact with and releasably fixed to the contacts resulting in the first and second conductive members being electrically connected via the plurality of conductive paths; and (2) a connector housing for receiving and containing the terminal block assembly.

In one exemplary embodiment, the printed circuit board includes a set of first through openings formed therein for receiving the first conductive members and a set of second through openings for receiving ends of the contacts. The first conductive members typically are in the form of conductive pins that are received in the set of first through openings, with each first through opening being conductively connected to a first end of one of the conductive paths formed on a face of the printed circuit board. A second end of the one conductive path is conductively connected to one of the second through openings which can be arranged in two rows, one row being formed along an upper edge of the printed circuit board, the other row being formed along a lower edge of the printed circuit board. Each conductive path extends between one of the first through openings and one of the second through openings, thereby electrically connecting one of the first conductive members to one of the second conductive members.

In one exemplary embodiment, the terminal block housing includes: a plurality of first openings for receiving respective contact fasteners; a plurality of second openings for receiving ends of the second conductive members and a plurality of third openings for containing the contacts. Each second opening is axially aligned and in direct communication with one third opening so as to permit the end of the second conductive member to be inserted and disposed adjacent a length of one contact. One first opening forms an entrance into one third opening to permit the contact fastener to be placed in contact with the inserted end of the second conductive member.

According to one aspect of the present invention, the components of the terminal block assembly are carefully orientated and dimensioned so that at least the one or more terminal blocks and preferably, at least the one or more terminal blocks and the circuit board and more preferably, at least the one or more terminal blocks, the circuit board and at least a portion of the connector base body are received and contained within the interior of the housing when the housing is assembled to form the connector. In order to achieve the aforementioned, the assembly is carefully constructed. More specifically, the profile of the body is constructed so that the profile of each of the circuit board and the one or more blocks is less than the profile of the connector base body.

In another aspect of the present invention, the connector is a vertical PC mount connector since, as is known in the art, this type of connector is one in which the printed circuit board is vertically orientated relative to the connector base and the one or more terminal blocks. One of the construction details that permits the current connector to have the advantaged mentioned herein is that the conductive members associated with the terminal block assembly are axially aligned with one another. More specifically, there is an axial relationship between a number of the conductive members of the connector and more particularly, distal ends of the wires, where the wires are in contact against the section of the contact, are axially aligned with the pins. In particular and advantageously, the distal end of the wire is axially aligned with at least substantially the entire length of the pin. Moreover, the sections of the contacts are likewise axially aligned with the pins. By placing the circuit board in a vertical orientation and axially aligning the conductive members of the connector, the terminal block assembly can be constructed and configured so that it can fit within a standard housing.

The terminal block of the block assembly provides a number of advantages over conventional terminal blocks that are part of an electrical connector, such as a grid array connector, e.g., a VGA connector. More specifically, the means and method for securely capturing and fixing the conductive wires (first conductive members) relative to the contacts are a vast improvement over the conventional means of using a solder mass to individually solder each wire to one contact.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which.

DETAILED DESCRIPTION OF PREFERRED EMBODIMENTS

Figure 1:
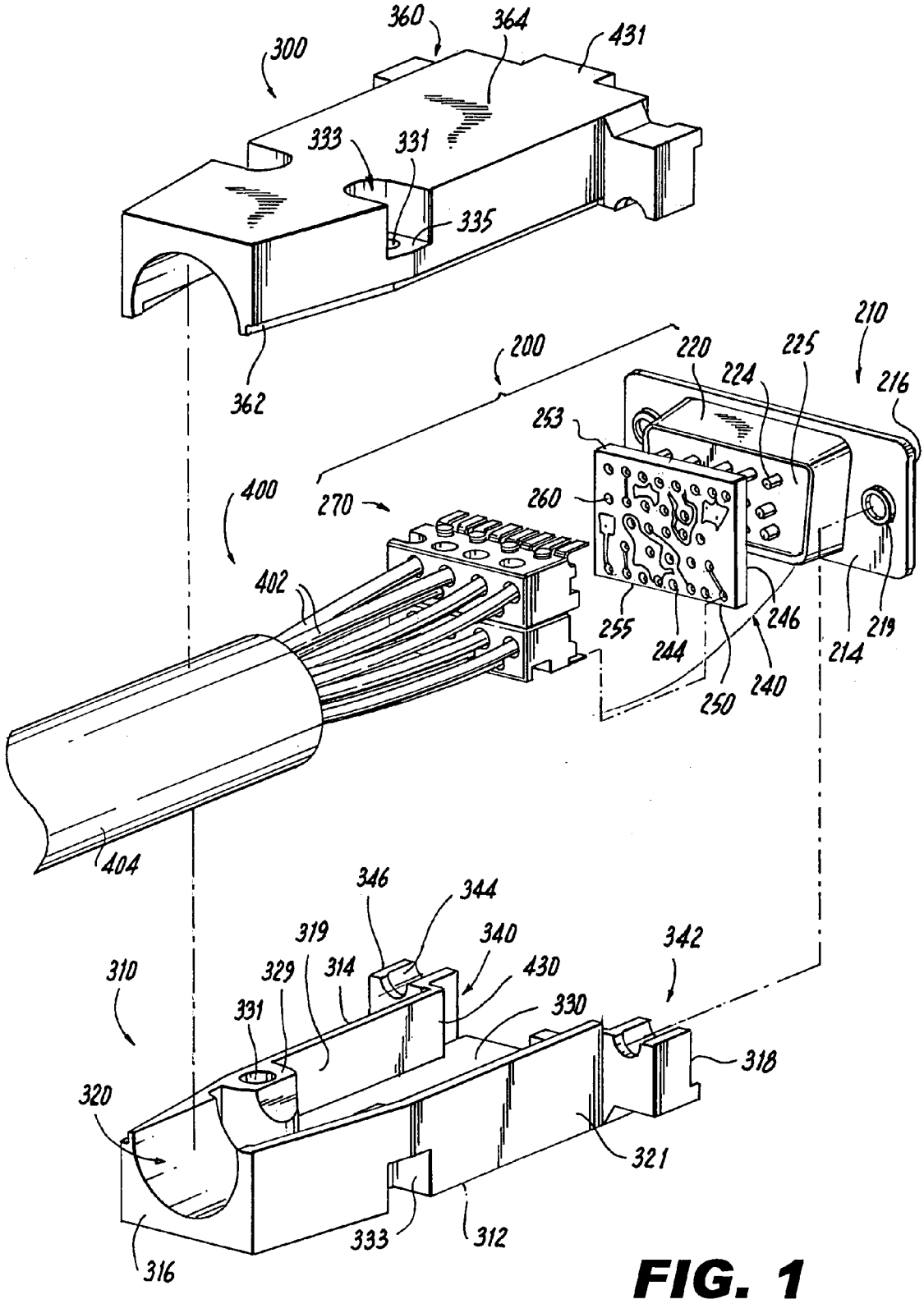
FIG. 1 is an exploded perspective view of an electrical connector according to one exemplary embodiment for mating with first and second electronic components.
Figure 2:
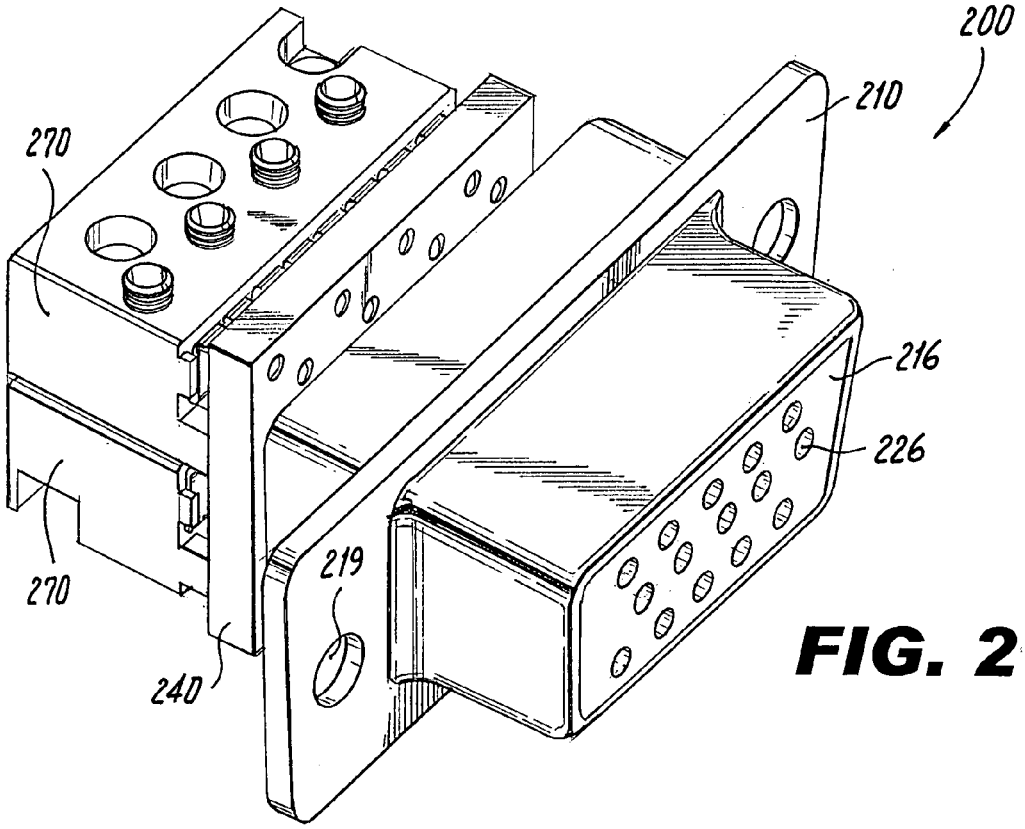
FIG. 2 is a perspective view of connector base according to one embodiment that forms a part of a terminal block assembly shown in FIG. 1.
Figure 9:
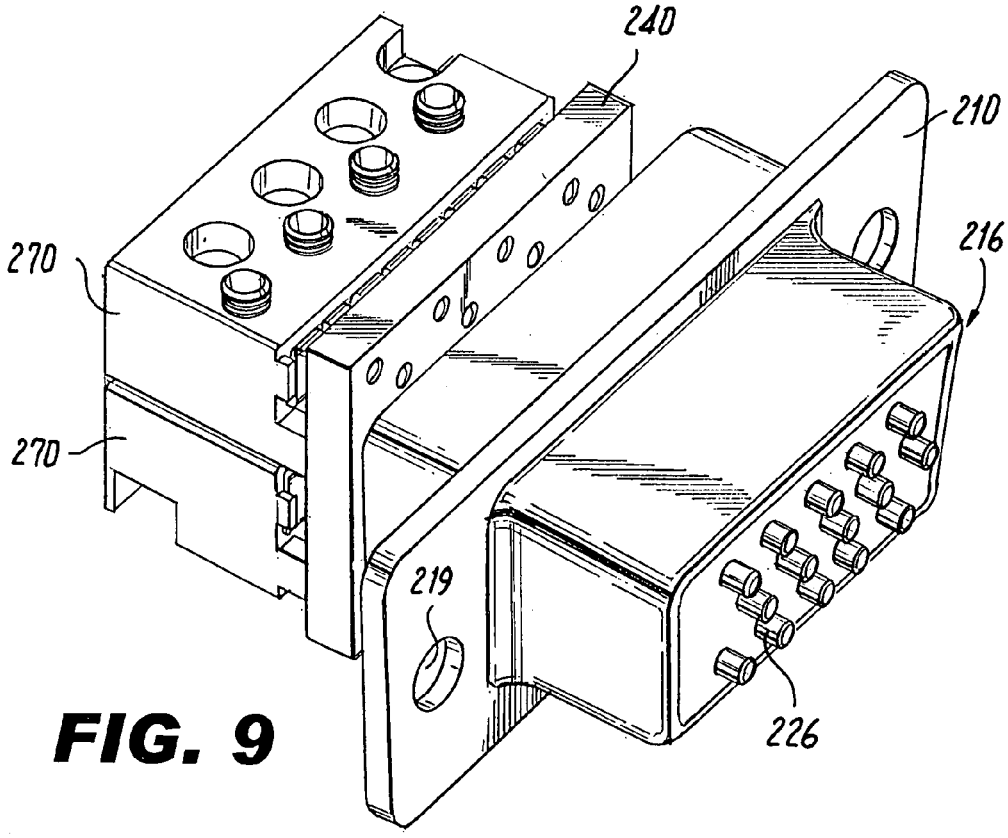
FIG. 9 is a perspective view of connector base according to another embodiment that forms a part of a terminal block assembly shown in FIG. 1.
Figure 3:
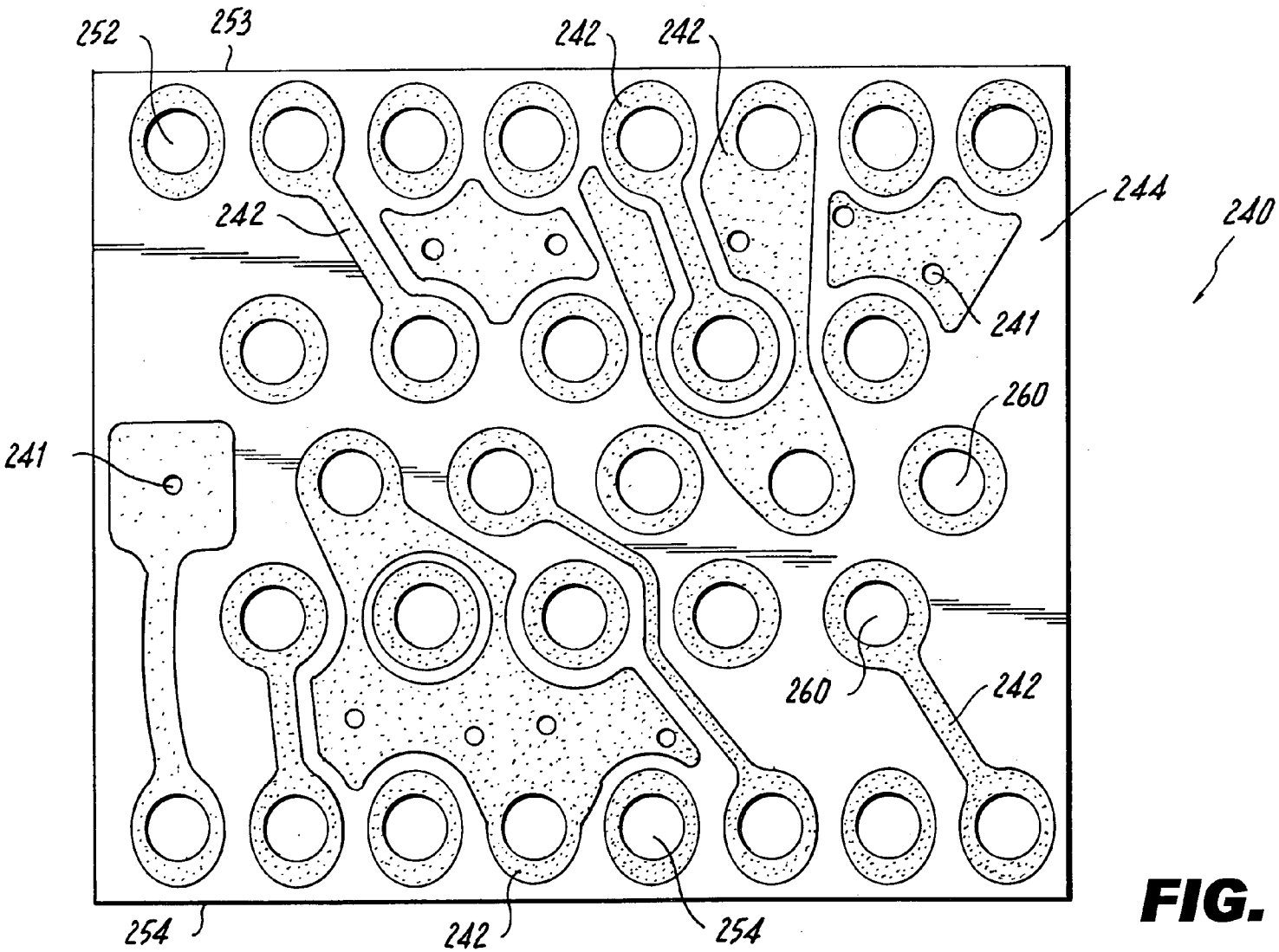
FIG. 3 is a side elevation view of a first surface of a printed circuit board that forms a part of the terminal block assembly shown in FIG. 1.

FIG. 1 shows an electrical connector 100 according to one exemplary embodiment. The electrical connector 100 is intended to electrically connect a first electronic component 110 to a second electronic component 120. In one exemplary embodiment, the electrical connector 100 is a grid array type connector. For example, one type of grid array connector is a VGA type connector that is particularly suited to electrically connect a VGA monitor (computer monitor) to a piece of hardware, e.g., a hard drive. However, it will be understood that the electrical connector 100 is not limited to being only a VGA type connector but rather it can be any number of other type of electrical connectors. In other words, the illustration and description of the connector as being a VGA connector is merely exemplary and not limiting of the present invention.

Display information that is generated by the computer hardware is provided in analog form and once it is in this form, the display information is set to the monitor through a VGA cable. The VGA cable is formed of a cable sheath or protective covering that surrounds a plurality of independent wires, e.g., 15 wires in the case of a 15 pin VGA connector, and serves to carry signals from one computer component to the other. A typical VGA connector has three separate lines for the red, green and blue color signals and two lines for horizontal and vertical synchronizing signals. A VGA type monitor receives these red, green and blue color signals differently than they are received by a conventional television. More specifically, in a conventional television, all of the above recited signals are combined into a single composite video signal; however, in the case of the VGA monitor, the signals are not combined but rather are carried separately. The separation of the signals is one reason why a computer monitor can have so many more pixels than a television set. In other words, the plug on a VGA monitor is not accepting a composite signal but rather, the VGA plug separates out all of the signals so they can be interpreted by the monitor more precisely. The VGA connector uses the "sense" lines as a way of telling what kind of monitor is connected. In other words, the ID bit pins in the 15 pin connector are usually shorted and left open to identify the type of monitor.

One exemplary connector 100 is generally formed of two components, namely a terminal block assembly 200 and a housing 300 that receives and contains the terminal block assembly 200. The housing 300 can have any number of different constructions so long as it is configured to receive and hold the terminal block assembly 200 in a secure manner as described in greater detail hereinafter. The housing 300 can also be formed of any number of different parts that cooperate and engage one another to form the housing 300. For example, the housing 300 can be formed of a first housing part 310 and a second housing part 360 that cooperate with one another so as to define a compartment 330 for receiving and holding the one or more terminal block assemblies 200.

The first housing part 310 has a planar lower surface 312 and an opposing upper surface 314 that is contoured with a number of different features that cooperate with the one or more terminal block assemblies 200 as well as providing fastening points for fastening the first housing part 310 to the second housing part 360. The illustrated exemplary housing 300 is designed such that the first housing part 310 is a mirror image of the second housing part 360 and therefore, they are configured to complementarily mate with each other. Thus, the upper surface 314 of the first housing part 310 is identical to a lower surface 362 of the second housing part 360, while an upper surface 364 of the second housing part 360 is identical the lower surface 312 of the first housing part 310. Since the first and second housing parts 310, 360 are mirror images of one another, only the first housing part 310 will be described in detail below for sake of brevity. It will therefore be appreciated that the features that are described relative to the first housing part 310 are equally applicable to the second housing part 360.

The first housing part 310 has a first end 316 and an opposing second end 318 and is generally divided into a number of different sections. More specifically, the first housing part 310 includes a first section 320, a second section 330 and a third section 340. The first section 320 is formed at the first end 316 and the third section 340 is formed at the second end 318. The first housing part 310 has two opposing side walls 319, 321.

The first section 320 is formed of a smooth arcuate surface, e.g., generally hemispherical, that extends between the opposing side walls 319, 321. It will be appreciated that when the first and second housing parts 310, 360 mate together, the first sections 320 define an annular opening with a smooth surface and is dimensioned to receive a cable 400 therein. The smooth surface is free of an obstruction so that the cable 400 can freely slide therealong and engage the terminal block assembly 200 as will be described in greater detail hereinafter. Between the first section 320 and the second section 330, the first housing part 310 includes a pair of first fastening lugs 329 that are formed along the opposing side walls 319, 321. Each lug 329 is in the form of an upstanding block or the like that has a bore 331 formed therethrough from the upper surface 314 to the lower surface 312. The upstanding lug 329 is essentially hollow since the lower surface 312 includes a pair of cut outs 333 formed at the sides 319, 321 so as to define a planar floor 335 through which the bore 331 is formed through. Thus, the cut out 333 defines a recessed section of the upper surface 312 and is dimensioned to receive a first fastening element 410, such as a threaded bolt, that mates with a second fastening element 420, such as a threaded screw. By being recessed, the first fastening element 410 and any head portion of the second fastening element 420 do not extend beyond the respective upper or lower surface 312, 314 of the housing part. The first and second fastening elements 410, 420 can be in the form of a screw and bolt or any other type of fastening elements that are suitable for the intended application.

The second section 330 is formed of the two opposing spaced side walls 319, 321 with a floor being formed therebetween. The walls 319, 321 are preferably not parallel to one another but are slightly angled with respect to one another; however, it will be appreciated that the housing 310 is not limited to this construction and that the housing 310 can have any number of other constructions, including parallel walls 319, 321.

The third section 340 includes a pair of second fastening lugs 342 that are formed along the opposing side walls 319, 321. Each lug 342 is in the form of an outwardly extending flange or finger that extends beyond the sides 319, 321. Each lug 342 has an arcuate shaped groove 344 formed therein. In the illustrated embodiment, the opening of the groove 344 faces away from the first surface 312 and the groove 344 has a generally hemi-spherical shape. A pair of planar surfaces 346 is formed on the sides of the groove 344 to permit the first and second housing parts 310, 360 to seat flush against one another. The lugs 342 of the first housing part 310 are complementary to the lugs 342 of the second housing part 360 and in fact are merely mirror images thereof such that when the first and second housing parts 310, 360 mate with one another, the planar surfaces 346 of the two parts seat against one another and the grooves 344 are aligned such that one pair of grooves 344 defines a fully enclosed bore (annular through opening) that receives fastening elements 410 similar to the bore 331 for mating with complementary fastening elements 420 so as to permit the housing 300 with the terminal block assembly 200 contained therebetween to be attached to another electronic component.

An axis of the bore defined by the grooves 344 is not parallel to an axis of the bore 331 but rather the axis is substantially perpendicular thereto. A shoulder 430 is located between the second section 330 and the third section 340 and serves to locate and contain the terminal block assembly 200 as described below. A pair of lips or tabs 431 are formed at the end 318 of the housing and serve to locate and hold the assembly 200 in place when the assembly 200 is disposed between and the housing parts 310, 360 are securely attached to one another. More specifically, when the assembly 200 is properly inserted into the housing 200, the connector base 210 rests between the parts 310, 360 and by clamping the housing parts 310, 360 together, forces are applied to the connector base 210 so as to effectively clamp or pinch the base 210 between the housing parts 310, 360.

This pinching action serves to locate and hold the assembly 200 in place within the housing 300 so as prevent the assembly 200 from moving around in the housing 300 when the connector 100 is used in the field and optionally is repositioned.

Now referring to FIGS. 1–9, as previously mentioned, the terminal block assembly 200 forms a part of the present connector 100 and is typically formed of a number of complementary parts that engage and interface with one another to form the assembled terminal block assembly 200. More specifically, the terminal block assembly 200 includes a connector base 210, a substrate 240, and one or more terminal blocks 270.

The illustrated connector base 210 is in the form of a female connector that includes a base member 212 that is preferably a planar plate-like member having a first surface or face 214 that faces the substrate 240 and an opposing second surface or face 216. While the base member 212 can have any number of different shapes, the illustrated base member 212 has a rectangular shape with a pair of openings 219 being formed therethrough at or near two ends of the base member 212. However, the base member 212 can have any number of different shapes and the number of openings 219 can vary.

The base member 212 also has a connector body 220 formed as a part thereof and more particularly, the connector body 220 extends outwardly from both the first face 214 and the second face 216. In one exemplary embodiment, the body 220 is defined by a perimeter wall or housing that surrounds one or more contact members 224, 226. For example, on the first face 214, the contacts 224 are in the form of a predetermined number of upstanding conductive pins 224 that are securely attached to and extending outwardly from a platform or floor 225 which is located inside of the wall 220. In the illustrated embodiment, there are fifteen (15) conductive pins 224 since the illustrated connector 100 is in the form of a fifteen pin VGA type connector. Conversely, the opposite site of the body 220 that is located adjacent the second face 216 includes a plurality of contact members 226 in the form of a plurality of openings that have conductive surfaces or at least provide a conductive interface between a conductive male member, such as a pin, that is received therein and the conductive pins 224 that extend outwardly from the opposite face 214.

It will be appreciated that while the connector base 210 is described and illustrated in the present application as being part of a female connector, it is not limited to being such a device but rather, the connector base 210 can also be in the form of a male connector or another type of connector. When the connector base 210 is part of a male connector, the contact members 226 are in the form of male contacts, such as pins, as opposed to being female contacts, such as openings as in FIG. 9.

The substrate 240 serves as an interface between the conductive contacts or leads 224, 226 associated with the connector base 210 (body 220) and the conductive members that are associated with the one or more terminal blocks 270. In other words, the substrate 240 provides a surface on which conducting paths can be provided and routed so that a proper and desired conductive relationship can be established between conductive members that are associated with the body 220 and the one or more terminal blocks 270. In a basic form, the substrate 240 is in the form of a conventional printed circuit board (PCB) that includes conducting paths formed thereon.

Figure 4:
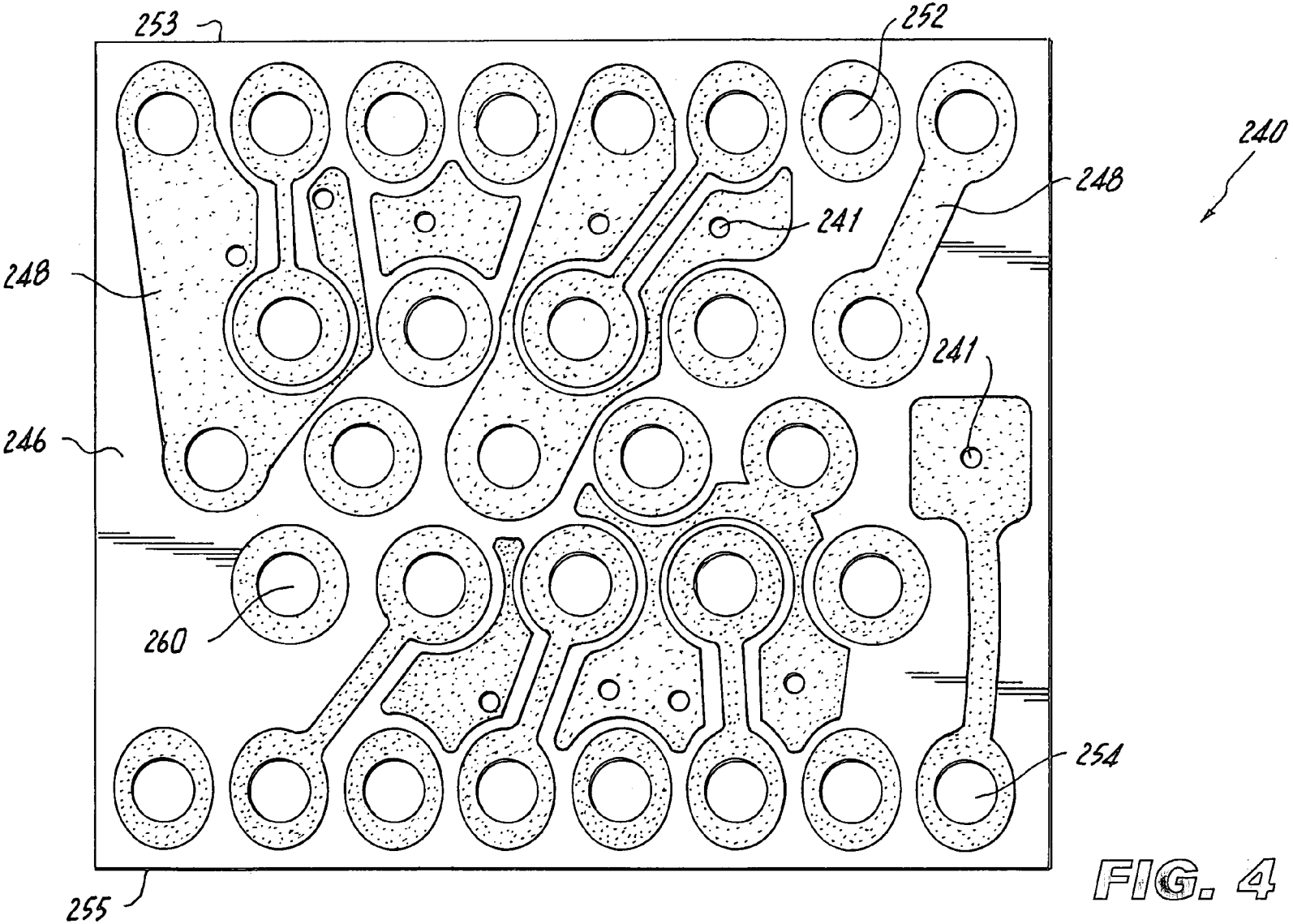
FIG. 4 is a side elevation view of a second surface opposite the first surface of a printed circuit board that forms a part of the terminal block assembly shown in FIG. 1.

More specifically, the illustrated printed circuit board 240 has a set of first conductive paths, generally indicated at 242, formed on a first face or surface 244 thereof (FIG. 3), while an opposite second face or surface 246 contains a set of second conductive paths, generally indicated at 248 (FIG. 4). One exemplary printed circuit board 240 is formed so that it includes a number of through openings 250 formed therethrough and more particularly, the through openings 250 are arranged in a first row 252 that is formed along one edge 253 thereof and a second row 254 that is formed along another edge 255 thereof. In the illustrated embodiment, the edge 253 is an upper edge of the printed circuit board 240, while the edge 254 is a lower edge of the printed circuit board 240. The number of through openings 250 is selected in view of the number of separate conductive members, such as the conductive pins 224, that are present in the connector. The number of openings 250 in the first row 252 is not necessarily but is typically equal to the number of openings 250 that are part of the second row 254. Since the exemplary illustrated connector 100 includes fifteen conductive members, the illustrated printed circuit board 240 includes eight (8) through openings 250 in the first row 252 and eight (8) through openings 250 in the second row 254. Each through opening 250 is preferably coated with a conductive material so facilitate an electrical connection with a member inserted therein.

It will further be appreciated that the printed circuit board 240 can include one or more vias 241 that are formed therethrough in select locations so as to permit a trace (part of one conductive path) to go from one of the surfaces 244, 246 to the other of the surfaces 244, 246 due to spatial constraints on the surfaces 244, 246. In other words, one section of the conducting path 242, 248 is formed on one of the surfaces 244, 246 and then travels through the vias to the other surface 244, 246 where the remaining portion of the conducting path 242, 248 is formed on the other surface 244, 246.

The printed circuit board 240 also has a number of other through openings 260 formed therethrough to accommodate and receive the contact members 224 (conductive pins). Accordingly, in the illustrated embodiment, there are fifteen through openings 260 for receiving the fifteen conductive pins 224. The through openings 250 are preferably made conductive by disposing a conductive material therein, such as a conductive liner, to permit a strong conductive path from one contact to another contact. While the through openings 260 can be arranged in any number of different ways, they are preferably arranged in a number of rows and are located between the first row 252 and the second row 254 of through openings 250. Accordingly, the through openings 260 can be arranged in a plurality of rows that have the same or about the same number of openings per each row. Thus, the illustrated printed circuit board 240 includes through openings 260 formed in three staggered rows, with five openings per row.

It will be appreciated that the arrangement and spacing of the through openings 260 have to be complementary to the arrangement and spacing of the conductive pins 224 such that when the connector base 210 and the printed circuit board 240 are mated to one another, the pins 224 are freely received in the openings 260 and the second face 246 is disposed adjacent the first face 214. Typically, in the assembly of the connector 100, the conductive pins 224 are trimmed after the printed circuit board 240 is mated with the connector base 210 and after pins attached to the board, as by solder, such that the pins 224 are flush with the first face 244 of the printed circuit board 240. In other words, the pins 224 are trimmed flush relative to the printed circuit board 240 so that the pins 224 do not extend significantly beyond the first face 244 and thereby do not interfere with the mating of the one or more terminal blocks 270 with the printed circuit board 240.

The terminal block 270 is best shown in FIGS. 1 and 5–7 and is constructed to selectively receive and clamp or hold conductive members 402 therein in such a way that a conductive path can be established between the conductive members 402 and the first conducting paths 242 formed on the printed circuit board 240. According to one exemplary embodiment shown in FIG. 1, the conductive members 402 are in the form of conductive wires, elongated contacts, conductive pins, etc. In one exemplary embodiment, members 402 associated with the cable 400, such as a VGA cable, is provided and is formed of an outer protective sheath 404 that surrounds conductive members 402 which are in the form of a plurality of separate co-axial wires each containing protective sheath. As will be described in greater detail below, there is a relationship between the number and location of the conductive wires 402 and the conductive pins 224. In other words, a conductive path is formed between one conductive wire 402 and one conductive pin 224 via the conducting paths 242, 248 formed on the opposing faces 244, 246 of the printed circuit board 240.

The terminal block 270 is generally in the form of a housing or body that is configured to receive the conductive wires 402 and has a fastening feature that permits each conductive wire 402 to be interfaced with and securely coupled to a conductive contact in a manner that eliminates the need for using solder or the like to establish such a conductive connection between these two members. More specifically, the terminal block 270 has a body 272 that has at least a first face 274 that receives the conductive wires 402, a second face 276 that receives manipulable fastening elements 278 (contact fasteners), and a third face 280 that includes contacts 290 that are constructed to mate with the printed circuit board 240.

Figure 5:
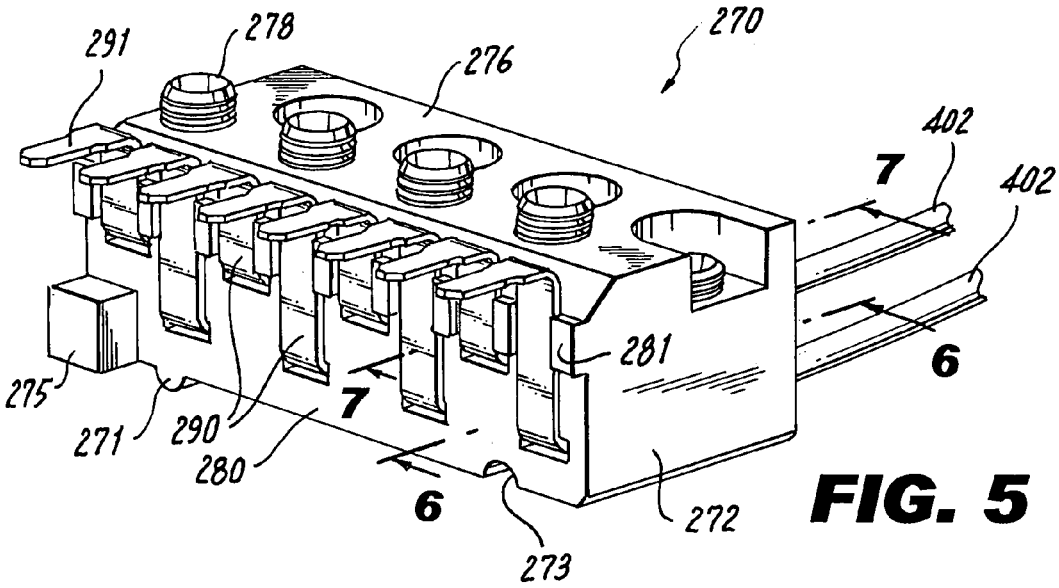
FIG. 5 is a perspective view of a terminal block that forms a part of the terminal block assembly shown in FIG. 1.
Figure 6:
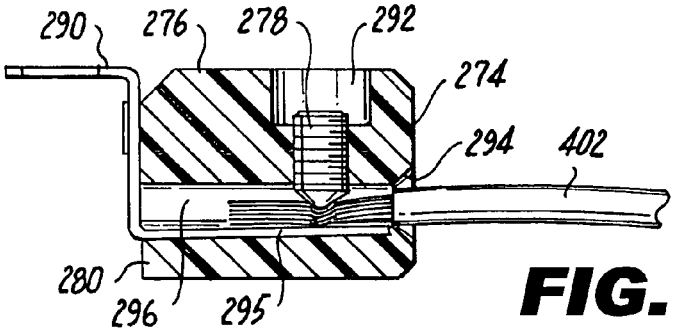
FIG. 6 is a cross-sectional view taken along the line 6—6 of FIG. 5.
Figure 7:
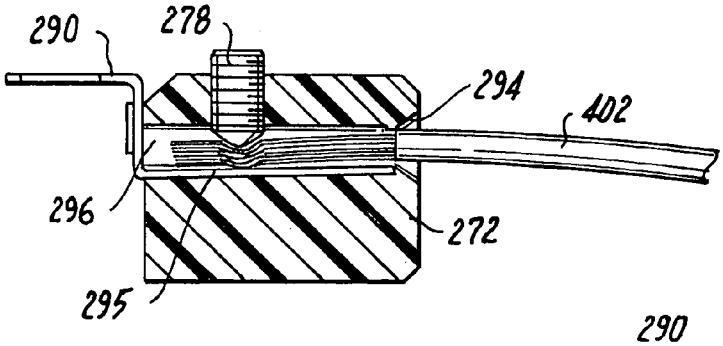
FIG. 7 is a cross-sectional view taken along the line 7—7 of FIG. 5.

The body 272 is generally a hollow body that is constructed to receive and contain ends of the conductive wires 402, the fastening elements 278, and the contacts 290. The body 272 is best shown in FIG. 5 and in the cross-sectional FIGS. 6–7. As can be seen, the body 272 has a number of different openings or passageways formed therein to accommodate the above described members. More specifically and according to one exemplary embodiment, the body 272 includes a first opening or channel (bore) 292 for receiving one fastening element 278, a second opening 294 for receiving the conductive wire 402, and a third opening or channel 296 for receiving at least a portion of the contact 290.

All three openings 292, 294, 296 are in communication with each other and in particular, the second opening 294 is formed at one end of the third opening or channel 296 such that the two are in free and direct communication with one another. In the illustrated embodiment, the second opening 294 is coaxial with the third opening or channel 296. The first opening 292 forms an entrance to the third opening 296 and can be formed at substantially a right angle to thereto; however, other configurations are equally suitable.

The exemplary body 272 includes a plurality of first openings 292 that are arranged in a staggered and counter sunk manner so as to permit all of the first openings 292 to be formed in the single first face 274. Exemplary first openings 292 can have any number of shapes so long as they are complimentary to the shapes of the fasteners 278 to permit reception thereof. For example, the illustrated first openings 292 are circular in shape to accommodate the fasteners 278 that likewise are circular in shape. While any number of types of fasteners 278 can be used to contact the conductive wire 402 and apply a force thereto so as to securely hold the conductive wire 402 against the contact 290, one suitable fastener 278 is a set screw that can easily be accessed and manipulated by a technician or installer as described below. It will be understood that one first opening 292 and one fastener 278 is associated with and aligned with one contact 290 that is inserted in one third opening 296. In other words, the number of first openings 292 and fasteners 278 correspond to the number of contacts 290 and conductive wires 402. The contact fasteners 278 can be formed of any number of different materials, including plastics and metals; however, preferably the fasteners are formed of metal.

It will also be appreciated that the fastener 278 can take other forms so long as the user can simply manipulate the fastener to cause it to apply pressure against the wire 402 resulting in it being held against a conductive surface of the contact 290. For example, a push button mechanism that is movable between a retracted position where it does not contact the wire 402 and an extended position where it clamps the wire 402 against the contact 290 can be constructed. Also, the fastener 278 can be in the form of a ratcheting plug that can be moved from a retracted position to an extended position by ratcheting a pawl of the plug against complementary teeth formed in the opening that receives the fastener 278.

Second opening 294 is preferably inwardly tapered (conical) in shape, with the mouth thereof having the larger diameter, so as to assist the user in inserting the conductive wire 402 therein and then feeding the wire 402 so that is positioned in close proximity to the contact 290, e.g., an end of the wire 402 is placed adjacent to a length of the contact 290.

Figure 8:
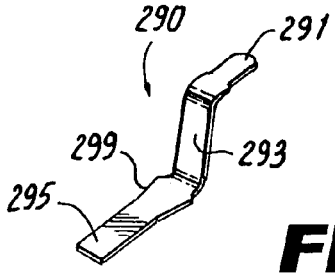
FIG. 8 is a perspective view of one exemplary contact for use in the terminal block of FIG. 5.

The contacts 290 are conductive members, e.g., metal contacts, that are bent so that they can be easily disposed in the body 272, more particularly, within the third openings 296, and also include end sections that extend out from the body 272 for interfacing with the printed circuit board 240. Typically, the contact 290 is a bent structure so that it can be both disposed in the third opening 296 and extend along the third face 280 of the body 272. As shown in FIG. 8, one exemplary contact 290 is a bent structure formed of a first section 291 that is configured for reception in one through opening 250 formed in one of rows 252, 254 in the printed circuit board 240; a second section 293 that is formed at a proximal end of the first section 291 and at an angle relative thereto; and a third section 295 that is connected to the second section 293 at an end opposite the end where the first and second sections 291, 293 are connected. The third section 295 is typically the longest of the three section since the third section is the section that lies within the body 272 and more particularly, lies along a length of the third opening 296.

One exemplary contact 290 has an "S" shape with the first section 291 and the third section 295 being parallel to one another but lying in different planes, with the second section 293 being substantially perpendicular to both the first and third sections 291, 295. The contact 290 is mated to the body 272 by disposing the third section 295 thereof within the third opening 296, whereby the second section 292 is disposed along the third face 280. Preferably, the third section 295 includes features 299 that assist in locating and/or locking the contact 290 in place within the third opening 296. For example, the features 299 can be in the form of a pair of darts that are formed along side edges of the third section 295 proximate the location where the second and third sections 293, 295 are joined.

The third face 280 of the body 272 includes a number of tabs or barbs 281 that are arranged in pairs and spaced apart so that the contact 290 can be securely disposed between two adjacent tabs 281 that form one pair resulting in the contact being securely held in place. In other words, the second section 293 of the contact 290 is disposed between one pair of tabs 281 and is held therebetween as by a frictional fit. The tabs 281 thus locate and hold one contact 290 so that the contact 290 can not freely move and make contact with another conductive contact 290 which would likely result in short circuiting of the connector 100. Thus, it is important that each contact 290 remains isolated from the other contacts 290 to eliminate such an adverse event.

It will be appreciated that the third openings 296 are formed in the third face 280 in a staggered arrangement, similar to the first openings 292, to permit all of the contacts 290 to be positioned along the third face 280. For example, the illustrated terminal block 270 has eight third openings 296 arranged in two staggered rows of four openings per row. When the contacts 290 are inserted and securely coupled to the body 272, the first sections 291 should all lie substantially within the same plane and extend outwardly from the body 272 in a location generally where the first and third faces 274, 280 intersect.

In order to have the first sections 291 lie all in substantially the same place, the contacts 290 are made in two different sizes in that the second sections 293 of one set of contacts 290 are longer than second section 293 of the other set of contacts 290. More specifically, the contacts 290 that are located in the openings 296 further away from the second face 276 have longer second sections 293.

The terminal block 270 preferably includes one or more locating and/or locking features that facilitate the coupling of one terminal block 270 to another terminal block 270. For example, one exemplary terminal block 270 has a locating ridge 271 formed on a fourth face 287 and a locating channel (recess) 273 is formed as well on the fourth face 287. It will be appreciated from viewing the overall connector 100 and the design of the printed circuit board 240 that when two terminal blocks 270 are coupled to one another, they are stacked with respect to one another one terminal block 270 is inverted such that the contacts 290 are formed along the two outer edges of the combined terminal blocks 270 as opposed to any of the contact rows being disposed along the interface between the two terminal blocks 270. Thus, the two terminal blocks 270 are arranged so that one locating ridge 271 of one block 270 is received within one locating channel 273 of the other block 270 and vice versa as shown in FIG. 1.

Each terminal block 270 also preferably includes a stop 275 that is formed on the third face 280 and is designed to space the terminal block 270 from the first face 244 of the printed circuit board 240 when the two are connected to one another. One exemplary stop 275 is in the form of a simple protrusion, e.g., a block or cube, that is formed on the third face 280. When the two terminal blocks 270 are mated to one another, the arrangement of the second openings 294 is identical or substantially the same as the arrangement of the through openings 260 formed in the printed circuit board 240 and the arrangement of the conductive pins 224. In the fifteen pin embodiment, one terminal block 270 receives conductive wires numbered 1–8, while the other terminal block 270 receives conductive wires numbered 9–16 and these preferably, directly correspond to conductive pins 224 that are numbered 1–8 and 9–16, respectively.

The operation/installation of the connector 100 is now described. The individual components of the connector 100 can be assembled in a number of different ways with the following representing merely one order of assembling these components. The printed circuit board 240 is provided and is mated with the connector base 210 by inserting the conductive pins 224 through the through openings 260 that are formed in the printed circuit board, resulting in the second face 246 of the printed circuit board 240 being brought into contact with the platform or face 225 of the connector base 210.

As a result, the conductive pins 224 are conductively in contact with the conductive surfaces associated with the through openings 260 and more particularly, the first and second conductive paths 242, 248 formed on opposite faces of the printed circuit board 240 are placed in conductive contact with the conductive pins 224. As will be appreciated, the first and second conductive paths 242, 248 serve to provide a conductively connect one conductive pin 224 in its respective through opening 260 with one of the contacts 290 that is received within one through opening 250 that is formed along one of the edges 253, 254 of the printed circuit board. As previously mentioned, due to surface area constraints and limitations, all of the conductive paths needed to individually and conductively connect one pin 224 in opening 260 with one contact 290 in one opening 250 can not be provided on one face of the printed circuit board 240 and therefore, some conductive paths (e.g., about one half) are provided on one face 244, while the remaining conductive paths are provided on the other face 246. The printed circuit board 240 can be coupled or attached to the connector base 210 using any number of conventional techniques, including soldering the pins 224 within the conductively lined through openings 260 along the first face 244 of the printed circuit board 240.

The conductive pins 224 are then trimmed flush as previously mentioned to prepare for the engagement or interfacing between the one or more terminal blocks 270 and the printed circuit board 240. The pins 224 are trimmed so that they do not contact or otherwise interfere with the coupling between the terminal blocks 270 and the printed circuit board 240. When more than one terminal block 270 is used in the connector 100, a group of the conductive wires 402 can either be inserted and fixed in place in one terminal block 270 and then the terminal blocks 270 can be coupled and fixed to one another or the terminal blocks 270 can first be fixed together and then the conductive wires are inserted and fixed within their respective terminal block 270.

According to the present invention, the connector 100 and more particularly, each terminal block 270 thereof offers an improved means for fixing the conductive wires 402 within the terminal block 270 such that the conductive wires 402 are securely and conductively in engagement with the contacts 290. More specifically, one conductive wire 402 is trimmed or otherwise manipulated so that the conductive wire itself is exposed from any sheathing, etc., and is then placed into its corresponding second opening 294 of the terminal block 270. When the wire 402 is inserted into the second opening 294, it is disposed next to (either above or below) the third section 294 of one contact 290. The wire 402 is directed axially along the length of the third section 295 of the contact 290 until a sufficient length of exposed wire 402 is disposed next to the third section 295 and until the wire 402 is disposed either above or below the respective first opening 292.

Once the conductive wire 402 is placed in this location, the user or technician simply inserts one fastener 278 (e.g., a set screw) into the first opening 292 and then uses a tool or the like to tighten the fastener 278 resulting in the fastener being directed towards the conductive wire 402 and the contact 290. As the fastener 278 is tightened, the fastener 278 is brought into contact with the wire 402 and further tightening of the fastener 278 results in the fastener 278 applying a clamping or pinching force against the wire 402, whereby the wire 402 is effectively pinched, clamped or captured between the fastener 278 and the contact 290. By means of tightening the fastener 278, the wire 402 can easily be conductively coupled to the contact 290 in a secure manner. Each of the other wires 402 is securely coupled to their respective contacts 290 in the same manner. It will be appreciated that the construction of the block 270 and more particularly, the formation of discrete openings or channels therein, serves to electrically isolate each wire 402 and each contact 290 pair from other wire and contact wires, thereby eliminating any chance of a short circuit. In the case where the assembly includes two terminal blocks 270, one set of fasteners are inserted into first openings 292 that lie across an upper face of the combined blocks, while the other set of fasteners are inserted into first openings 292 that lie across a lower face of the combined blocks.

The terminal block 270 provides a number of advantages over conventional terminal blocks that are part of electrical connectors, such as a VGA connector. More specifically, the means and method for securely capturing and fixing the wires 402 relative to the contacts 290 are a vast improvement over the conventional means of using a solder mass to individually solder each wire 402 to one contact 290. The conventional soldering technique was a painstakingly slow process since it required the technician to align each wire relative to the contact and then perform a soldering operation for each wire/contact pair. This leads to inefficient use of the technicians time since as is well known, a solder operations requires a number of steps, including preparing the solder material and then heating, reflowing and then waiting for the material to cool. Conversely, in the present invention, the technician can simply tighten fasteners 278 without any concern about soldering implications.

Another advantage of the present invention is that the coupling between the wire 402 and the contact 290 is reversible in that if for some reason, the technician wants to remove the conductive wire, the technician simply only needs to untighten (loosen) the fastener 278, thereby releasing the conductive wire from the contact 290. This is not true with a soldered connection since a solder operation for the most part is intended to be irreversible or at least not disturbed.

Instead the present means for conductively connecting the wire 402 to the contact 290 is very simple and straightforward and does not require the technician to use cumbersome materials, such as solder, that require preparation and then performing multi-step operations in the field. All the technician needs to do is insert the wire 402 and then use a simple tool to tighten the respective fastener 278 resulting in the wire 402 being pinched or clamped against the contact 290.

Once all of the wires 402 are securely and conductively attached to the contacts 290, the terminal block assembly 200 is then mated with the printed circuit board 240. To accomplish this, the first sections 291 of the contacts 290 are axially aligned with the openings 250 formed along the upper and lower edges 253, 255 of the printed circuit board 240 and then the first sections 291 which resemble prongs or the like are inserted into the through openings 250 in rows 252, 254 until the terminal blocks 270 are directed toward the first face 244 of the printed circuit board 240. The stops 275 act to limit the travel of the terminal blocks 270 relative to the printed circuit board 240 and they prevent the third face 280 from contacting the face first 244 of the printed circuit board 240. In other words, the stops 275 space the terminal blocks 270 from the printed circuit board 240. The terminal blocks 270 can securely connected to the printed circuit board 240 by any number of conventional techniques, including soldering the contacts 290 within the conductively lined openings 250 along the second face 246 of the printed circuit board 240.

The housing 300 can be formed of any number of different types of materials, including metal and plastic. When a plastic material is used, the housing 300 can be in the form of a molded member. It will be appreciated that the other non-conductive components of the connector 100 are typically formed from plastic materials, while the conductive members, such as the wires 402 and contacts 290, are typically formed from metals or other suitable conductive materials.

The exemplary terminal block assembly 200 is coupled to the housing 300 by inserting the stacked terminal blocks 270 between the side walls 319, 321 of one of the housing parts 310, 360 such that the printed circuit board 240 is positioned against the shoulder 430 formed between the second and third sections 330, 340 and the base member 212 of the connector base 210 is positioned so that the openings 219 formed therein are axially aligned with the arcuate shaped grooves 344 of the housing part 310, 360 that are formed as parts of the lugs 342. The other of the housing parts 310, 360 is then positioned above the terminal block assembly 200 and the one housing part 310, 360 and then is mated to the terminal block assembly 200 in an identical manner as was previously described. In this position, the cable 400 is cradled in the smooth arcuate surface defined in the first section 320. Then, fastening elements 410 are fed through the bore 331 and mate with complementary fastening elements 420 so as to securely couple the two housing parts 310, 320 together with the terminal block assembly 200 being securely fixed in place therebetween. Fasteners 410, 420 are used in combination with grooves 344 are used for attaching the connector 100 to an electronic component. It will be appreciated that the illustrated housing 300 is merely one example of a housing that is constructed to receive the illustrated terminal block assembly 200; however, other housings can be used, especially depending upon how many conductive pins and contacts form a part of the connector.

According to one aspect of the present invention, the present connector 100 and more particularly, the assembly 200 is constructed so that it can be received and contained within a standard housing design 300. As previously mentioned, one of the disadvantages of the prior connectors is that in order for the connector to receive all of the necessary contacts, it was constructed in such a way that it could not be received within a standard housing. One of the reasons why the terminal block assembly could not be received within the housing was that one or more of the circuit board 240 and the terminal block 270 had dimensions (width and height) that were greater than the dimensions of the body 220 of the connector base 210 and therefore, prevented the assembly from by inserted into the housing since the housing is typically constructed to fit relative to the dimensions of the body 220. Many times with the type of grid array connectors shown in the Figures, the construction and design of the connector prevent it from being disposed within a housing since one or more subcomponents of the terminal block assembly has dimensions greater than the block resulting in the assembly not being able to be received in the housing. If the terminal block assembly will not fit in the housing, the connector is placed in the field without a housing and as a result, the cable is not securely held relative to the connector and movement in the field of the components can therefore result in a degradation of the conductive interface between the terminal block and the cable. This results since the movement of the cable relative to the terminal block is not limited as is the case when a housing is used since the housing serves to cradle the cable within a groove and the attachment of the housing parts together effectively clamps the cable between the two housing parts, thereby limiting unnecessary and undesirable free movement of the cable relative to the terminal block. Accordingly, it is desirable for a housing to be used in combination with the terminal block assembly.

According to one aspect of the present invention, the components of the terminal block assembly are carefully orientated and dimensioned so that at least the one or more terminal blocks 270 and preferably, at least the one or more terminal blocks 270 and the circuit board 240 and more preferably, at least the one or more terminal blocks 270, the circuit board 240 and at least a portion of the body 220 are received and contained within the interior of the housing 300 when the housing 300 is assembled to form the connector 100. In order to achieve the aforementioned, the assembly 200 is carefully constructed. More specifically, the profile of the body 220 is constructed so that the profile of each of the circuit board 240 and the one or more blocks 270 is less than the profile of the body 220. As used herein the term "profile" refers to and is defined by the height and width of the respective part, e.g., the body 220, circuit board 240 or block 270. In other words, the maximum height and maximum width of the circuit board 240 is less than the height of the body 220, as measured at any point thereof, and the width of the body 200, as measured at any point thereof, respectively. Thus, when the assembly 200 is inserted into the housing 300, neither the one or more block 270 nor the circuit board 240 fit within the interior of the housing structure, thereby permitting the body 220 to be inserted into a standard housing.

In another aspect of the present invention, the connector 100 is a vertical PC mount connector since, as is known in the art, this type of connector is one in which the printed circuit board (board 240) is vertically orientated relative to the connector base 210 and the one or more terminal blocks 270. In contrast, a horizontal PC mount connector (also can be referred to as a right angle PC mount connector) is one in which the printed circuit board 240 is horizontally orientated relative to the connector base 210 and the one or more terminal blocks 270.

The present connector 100 is furthermore one in which the number of rows of conductive members in the connector base 210 can be greater than the number of rows of conductive members in the one or more terminal blocks 270. For example, in one embodiment and as illustrated, the connector base 210 has 3 rows of conductive pins 224 which mate with one face of the vertical circuit board 240, while the terminal blocks 270 define 2 rows of contacts 290 which mate with the other face of the vertical circuit board 240 (which is a dual through hole board). It will be appreciated that if the terminal blocks 270 had 3 rows of conductive members that are to mate with the through openings in the board 240, the middle row of conductive members would not be accessible to the technician for soldering or connection to the face of the board 240. Thus, the present design is permitted to create 2 rows of conductive members associated with the blocks 270 that are accessible at the top and bottom of the blocks 270, thus permitting the pins 224 to be inserted into middle through opening 260 and soldered to the face 244 of the board 240, and then the contacts 290 are inserted to the top and bottom of the board 240 and soldered to the other face 246 of the board 240.

The connector base 210 can have more than 3 rows and the blocks 270 can have more than 2 rows so long as in one embodiment, the number of rows in the connector base is greater than the number of rows in the blocks 270.

One of the construction details that permits the current connector 100 to have the advantaged mentioned herein is that the conductive members associated with the terminal block assembly 200 are axially aligned with one another. More specifically, there is an axial relationship between a number of the conductive members of the connector and more particularly, the distal ends of the wires 402, where the wires 402 are in contact against the section 295 of the contact 290, are axially aligned with the pins 224. In particular and advantageously, the distal end of the wire 402 is axially aligned with at least substantially the entire length of the pin 224. Moreover, the sections 291 of the contacts 290 are likewise axially aligned with the pins 224. By placing the circuit board 240 in a vertical orientation and axially aligning the conductive members of the connector 100, the terminal block assembly 200 can be constructed and configured so that it can fit within a standard housing. In conventional arrangements and most often in horizontal PC mount connector, the wires 402 and pins 224 are bent at right angle to connect to the board 240.

The strength of the signal transmitted through the conductive members of the connector 100 is improved in the present connector 100 compared to other connectors as a result of the wires 402 not being bent but rather being substantially straight and axially aligned with the other aforementioned contacts. Since the contact 290 has a smooth "S" like shape, the signal path is improved since the signal is not required to travel along a path that includes a number of twists and turns.

It will be appreciated by persons skilled in the art that the present invention is not limited to the embodiments described thus far with reference to the accompanying drawings; rather the present invention is limited only by the following claims.

What is claimed is:

1. An electrical connector for electrical connection to an electronic device comprising:

a terminal block assembly comprising:

a connector base having first conductive members associated with a shaped body portion of the connector base, the body portion extending outwardly from a connector base substrate and having a profile defined by a height and width thereof;

a printed circuit board that includes a plurality of conductive paths formed thereon and is coupled to the connector base such that the first conductive members contact the plurality of conductive paths;

one or more terminal blocks each formed of a housing that includes first openings for receiving second conductive members and a plurality of contacts disposed therein, the contacts contacting the plurality of conductive paths; and a plurality of contact fasteners that can be tightened so as to apply a force against the second conductive members so that they are brought into contact with and releasably fixed to respective contacts resulting in the first and second conductive members being electrically connected via the plurality of conductive paths, wherein a profile, defined by a height and a width thereof, of each of the printed circuit board and the one or more terminal blocks is less than the profile of the connector body portion; and a connector housing for receiving and containing the terminal block assembly in such away that at least the one or more terminal blocks and the printed circuit board are contained within an interior of the housing.

2. The electrical connector according to claim 1, wherein the connector base is in the form of a female connector base having connector openings for receiving complementary male contacts associated with the electronic device, the first conductive members being in the form of a plurality of conductive pins that are received within through openings formed in the printed circuit board resulting in the conductive pins being electrically connected to the plurality of conductive paths.

3. The electrical connector according to claim 1, wherein the connector base is in the form of a male connector base having male contacts for reception in complementary female contacts associated with the electronic device, the first conductive members being in the form of a plurality of conductive pins that are received within through openings formed in the printed circuit board resulting in the conductive pins being electrically connected to the plurality of conductive paths.

4. The electrical connector according to claim 1 comprising a grid array type connector.

5. The electrical connector according to claim 1, wherein the connector housing is formed of two parts with each part containing a plurality of fastening elements for securely yet releasably attaching the two parts together with the terminal block assembly being fixed in place between the two attached parts.

6. The electrical connector according to claim 5, wherein the two parts are mirror images of one another.

7. The electrical connector according to claim 1, wherein the contact fasteners comprise set screws.

8. The electrical connector according to claim 1, wherein the terminal block housing includes at least one stop formed on a surface thereof that faces the printed circuit board when the terminal block housing is coupled thereto, the at least one stop serving to space the terminal block housing a predetermined distance from the printed circuit board.

9. The electrical connector according to claim 1, wherein the terminal block housing includes locating features that serve to locate one terminal block housing relative to another one when the two are combined to form the terminal block assembly.

10. The electrical connector according to claim 1, wherein the terminal block housing includes a plurality of first openings for receiving respective contact fasteners; a plurality of second openings for receiving ends of the second conductive members and a plurality of third openings for containing the contacts, each second opening being axially aligned and in direct communication with one third opening so as to permit the end of the second conductive member to be inserted and disposed adjacent a length of one contact, wherein one first opening forms an entrance into one third opening to permit the contact fastener to be placed in contact with the inserted end of the second conductive member.

11. The electrical connector according to claim 10, wherein the first opening is formed substantially perpendicular to the third opening.

12. The electrical connector according to claim 10, wherein each second opening is an inwardly tapered opening.

13. The electrical connector according to claim 10, wherein the plurality of first openings are formed in a staggered relationship with some of the first openings being countersunk.

14. The electrical connector according to claim 10, wherein the terminal block housing includes a plurality of pairs of locating and retaining tabs, with an intermediate section of the contact being disposed and held between the pair of tabs in a friction tight manner, each contact being a bent structure formed of three sections, namely, a first section that extends away from the terminal block and is received in the third opening and a third section that is received within the third opening, the intermediate section being between the first and third sections.

15. The electrical connector according to claim 1, wherein the printed circuit board includes a set of first through openings formed therein for receiving the first conductive members and a set of second through openings for receiving ends of the contacts.

16. The electrical connector of claim 15, wherein the first conductive members comprise conductive pins that are received in the set of first through openings, each first through opening being conductively connected to a first end of one of the conductive paths formed on a face of the printed circuit board, with a second end of the one conductive path being conductively connected to one of the second through openings.

17. The electrical connector of claim 16, wherein the second through openings are arranged in two rows, one row being formed along an upper edge of the printed circuit board, the other row being formed along a lower edge of the printed circuit board.

18. The electrical connector of claim 17, wherein each conductive path extends between one of the first through opening and one of the second through openings, thereby electrically connecting one of the first conductive members to one of the second conductive members.

19. A terminal block assembly for use in an electrical connector comprising:

a base portion having first conductive members associated therewith and extending outwardly therefrom;

a printed circuit board that includes a plurality of conductive paths formed thereon and is coupled to the base portion such that the first conductive members contact the plurality of conductive paths;

one or more terminal blocks each including a housing that includes first openings for receiving second conductive members and a plurality of contacts fixedly disposed therein, the contacts contacting the plurality of conductive paths;

a plurality of contact fasteners received within second openings formed in the terminal block housing such that they can be tightened to apply a force against the second conductive members for bringing them into contact with and releasably fixing the second conductive members to respective contacts resulting in the first and second conductive members being electrically connected via the plurality of conductive paths; and wherein the printed circuit board is vertically orientated relative to the connector base and the one or more terminal blocks and at least distal ends of the second conductive members are axially aligned with the first conductive members, along at least a substantial length thereof.

20. The terminal block assembly according to claim 19, wherein the base portion is in the form of a female connector base having connector openings for receiving complementary male contacts associated with the electronic device, the first conductive members being in the form of a plurality of conductive pins that are received within through openings formed in the printed circuit board resulting in the conductive pins being electrically connected to the plurality of conductive paths.

21. The terminal block assembly according to claim 19, wherein the base portion is in the form of a male connector base having male contacts for reception in complementary female contacts associated with the electronic device, the first conductive members being in the form of a plurality of conductive pins that are received within through openings formed in the printed circuit board resulting in the conductive pins being electrically connected to the plurality of conductive paths.

22. The terminal block assembly according to claim 19, wherein the contact fasteners comprise set screws.

23. The terminal block assembly according to claim 19, wherein the terminal block housing includes a plurality of third openings for containing the contacts, each first opening being axially aligned and in direct communication with one third opening so as to permit the end of the second conductive member to be inserted and disposed adjacent a length of one contact, wherein one second opening forms an entrance into one third opening to permit the contact fastener to be placed in contact with the inserted end of the second conductive member.

24. The terminal block assembly according to claim 23, wherein the first opening is formed substantially perpendicular to the third opening and the plurality of first openings are formed in a staggered relationship with some of the first openings being countersunk.

25. The terminal block assembly according to claim 19, wherein distal ends of the contacts that mate with the conductive paths of the printed circuit board are axially aligned with the first conductive members, at least along a substantial length thereof.

26. The terminal block assembly according to claim 25, wherein distal ends of the second conductive members and distal ends of the contacts are axially aligned with the entire length of the first conductive members.

27. The terminal block assembly according to claim 19, wherein the printed circuit board includes a set of first through openings formed therein for receiving the first conductive members and a set of second through openings for receiving ends of the contacts.

28. The terminal block assembly of claim 27, wherein the first conductive members comprise conductive pins that are received in the set of first through openings, each first through opening being conductively connected to a first end of one of the conductive paths formed on a face of the printed circuit board, with a second end of the one conductive path being conductively connected to one of the second through openings.

29. The terminal block assembly of claim 28, wherein the plurality of conductive paths are divided into two sets of conductive paths, one set of conductive paths being formed on one face of the printed circuit board, the other set of conductive paths being formed on an opposite face of the printed circuit board.

30. The terminal block assembly of claim 28, wherein the second through openings are arranged in two rows, one row being formed along an upper edge of the printed circuit board, the other row being formed along a lower edge of the printed circuit board.

31. The terminal block assembly of claim 30, wherein each conductive path extends between one of the first through opening and one of the second through openings, thereby electrically connecting one of the first conductive members to one of the second conductive members.

32. A vertical PC mount connector for electrical connection to an electronic device comprising:

a terminal block assembly comprising:

a connector base having first conductive members associated with a shaped body portion of the connector base, the body portion extending outwardly from a connector base substrate;

a printed circuit board that includes a plurality of conductive paths formed thereon and is coupled to the connector base such that the first conductive members contact the plurality of conductive paths by being disposed in first through holes formed therein;

one or more terminal blocks each formed of a housing that includes first openings for receiving second conductive members and a plurality of contacts disposed therein, the contacts contacting the plurality of conductive paths by disposing first end sections of the contacts in second through holes formed therein;

a plurality of contact fasteners that can be tightened so as to apply a force against the second conductive members so that they are brought into contact with and releasably fixed to respective contacts resulting in the first and second conductive members being electrically connected via the plurality of conductive paths;

a connector housing for receiving and containing the terminal block assembly in such away that at least the one or more terminal blocks and the printed circuit board are contained within an interior of the housing; and wherein the printed circuit board is vertically mounted relative to the connector base and the one or more terminal blocks and is of a back-to-back through hole construction since the connector base is mounted on one face of the printed circuit board and the one or more terminal blocks are mounted on the other face of the printed circuit board.

33. The vertical PC mount connector according to claim 32, wherein the body portion of the connector base that is received and contained within an interior of the housing has a profile that is defined by a height and width thereof and wherein a profile, defined by a height and a width thereof, of each of the printed circuit board and the one or more terminal blocks is less than the profile of the body portion of the connector base.

34. The vertical PC mount connector according to claim 32, wherein the contact is substantially S-shaped and is formed of the first end section, a second end section opposite the first end section that contacts the distal end of the second conductive member and an intermediate section that joins the first and second end sections, wherein the both the first and second end sections are substantially axially aligned with the first conductive members.

35. The vertical PC mount connector according to claim 32, wherein the first through holes are arranged in a number of rows that are disposed between rows of the second through holes that are formed at upper and lower edges of the printed circuit board, respectively.

36. The vertical PC mount connector according to claim 35, wherein the first conductive members are arranged in a number of rows and the contacts are arranged in a number of rows less than the number of rows of the first conductive members.

37. A method of electrically connecting a first electronic component to a second electronic component comprising the steps of:

providing a terminal block assembly including: (a) a base portion having first conductive members associated therewith and extending outwardly therefrom; (b) one or more terminal blocks each including a housing that includes first openings for receiving second conductive members and a plurality of contacts fixedly disposed therein; and (c) a plurality of contact fasteners received within second openings formed in the terminal block housing;

inserting distal ends of the second conductive members within respective first openings such that ends of the second conductive members are disposed adjacent the contacts and such that the distal ends of the second conductive members are axially aligned with the first conductor members, at least along a substantial length thereof; and tightening the contact fasteners to apply a force against the second conductive members for bringing them into contact with and releasably fixing them to respective contacts resulting in the first and second conductive members being electrically connected via conductive paths formed on a printed circuit board that is disposed between the base portion and the one or more terminal blocks in a vertical orientation, the printed circuit board being of a vertical back-to-back through hole design such that the first and second conductive members are received within first and second through holes, respectively.

* * * * *